US009440372B2

(12) United States Patent
Holm

(10) Patent No.: US 9,440,372 B2
(45) Date of Patent: Sep. 13, 2016

(54) PROCESS FOR TREATING WOOD

(75) Inventor: Claus Ludvig Engelbrecht Holm, Espergaerde (DK)

(73) Assignee: GAIA WOOD PATENT A/S, Herning (DK)

( * ) Notice: Subject to any disclaimer, the term of this patent is extended or adjusted under 35 U.S.C. 154(b) by 508 days.

(21) Appl. No.: 12/680,232

(22) PCT Filed: Sep. 29, 2008

(86) PCT No.: PCT/IB2008/002542
§ 371 (c)(1),
(2), (4) Date: Mar. 18, 2011

(87) PCT Pub. No.: WO2009/040656
PCT Pub. Date: Apr. 2, 2009

(65) Prior Publication Data

US 2011/0212273 A1 Sep. 1, 2011

(30) Foreign Application Priority Data

Sep. 28, 2007 (DK) ..... 2007 01398
Sep. 28, 2007 (DK) ..... 2007 01399

(51) Int. Cl.
*B05D 3/00* (2006.01)
*B27K 3/08* (2006.01)
(Continued)

(52) U.S. Cl.
CPC ..... *B27K 3/08* (2013.01); *B27K 3/0214* (2013.01); *B27K 3/0292* (2013.01); *F26B 5/048* (2013.01); *F26B 2210/16* (2013.01)

(58) Field of Classification Search
CPC ..... B27K 3/08; B27K 3/0285; B27K 3/029; B27K 5/003; B27K 5/0055
USPC ..... 34/245, 255, 257; 219/773, 778, 779, 219/780; 427/532, 553, 297, 294
See application file for complete search history.

(56) References Cited

U.S. PATENT DOCUMENTS 3,968,276 A * 7/1976 Allen ..... 427/297
3,986,268 A * 10/1976 Koppelman ..... 34/257
3,987,219 A * 10/1976 Arvidsson ..... 427/297
(Continued)

FOREIGN PATENT DOCUMENTS

GB 1 467 420 3/1977
GB 2 271 579 4/1994
WO WO 03/037107 5/2003

OTHER PUBLICATIONS

International Search Report and Extended Search Report for PCT/IB2008/002542 Date: Feb. 16, 2009.
(Continued)

*Primary Examiner* — Michael Wieczorek
(74) *Attorney, Agent, or Firm* — Cermak Nakajima & McGowan LLP; Adam J. Cermak

(57) ABSTRACT

The proposed invention relates to a method for fluid treatment of wood comprising the steps of placing the wood in an airtight tank, evacuating the airtight tank to establish a vacuum environment for the wood, applying a fluid to the wood. Additionally, the method may further comprise the subsequent step of pressurizing the airtight tank to establish a pressurized environment for the wood. The method may further comprise the subsequent step of subjecting the wood to a subsequent heating, and/or the prior step of subjecting the wood to a prior heating by electromagnetic radiation through one or more electrodes.

22 Claims, 3 Drawing Sheets

(51) Int. Cl.
*B27K 3/02* (2006.01)
*F26B 5/04* (2006.01)

(56) References Cited

U.S. PATENT DOCUMENTS 4,402,781 A * 9/1983 Couture et al. ..... 156/274.6
4,678,686 A * 7/1987 Park ..... 427/254
5,245,154 A * 9/1993 Sato et al. ..... 219/773
5,575,083 A 11/1996 Lee et al.
6,083,437 A 7/2000 Nishio et al.
6,124,584 A 9/2000 Blaker et al.
6,274,199 B1 * 8/2001 Preston et al. ..... 427/298
7,141,118 B2 * 11/2006 Vaerewyck et al. ..... 118/50
2007/0184196 A1 * 8/2007 Wallace et al. ..... 427/297

OTHER PUBLICATIONS

Written Opinion of the International Searching Authority for PCT/IB2008/002542 Date: Jan. 18, 2010.

* cited by examiner

PROCESS FOR TREATING WOOD

TECHNICAL FIELD OF THE INVENTION

A method for fluid treatment of wood involving vacuum, high-pressure, and heating supplied in different stages is put forward. Additionally, the method can be employed for heat treatment of wood, e.g. for the purpose of drying.

BACKGROUND OF THE INVENTION (PRIOR ART)

In the wood industry, it is common that the wood is treated to obtain certain attributes or features, e.g. resistance to microorganisms, lower contents of natural fluids, altered structural properties, or a particular colour. However, a common and costly problem within wood treatment is warping of the wood, which is explained by two principal effects. Firstly, the warping may be a result of shrinkage anisotropy, resulting in cupping, bowing, and twisting. Secondly, the warping may be a result of uneven drying, leading to structural damage, such as raptures, external and internal checks, and splits One common step in wood treatment involves heating of a wooden product, which can be achieved by applying different forms of electromagnetic radiation. At the shortest wavelengths, the product is illuminated by infrared radiation, where the heat reaches the interior of the product through convection or conduction from the surface. Microwave radiation can also be applied for heating, where the temperature is increased through direct dielectric heating of the product. This gives a deeper penetration of the applied energy. At the longest wavelengths, the product can be subjected to high-frequency radio emission, which also increases the temperature through dielectric heating, but with a deeper penetration compared with that of microwave radiation, thereby enabling a more homogeneous heating.

For the case of a metal, high-frequency radio emission will induce eddy currents, which will heat the material. This electromagnetic inductive heating is the most efficient if the metal is ferromagnetic, which is the case for several industrial types of steel.

Vacuum drying is another common method in wood treatment, where the product is subjected to dielectric heating. As an example of a general application of vacuum treatment see U.S. Pat. No. 5,575,083. The vacuum lowers the boiling temperature, while the electromagnetic field increases the temperature, resulting in a more efficient drying when combining the techniques.

Another common step within wood treatment involves impregnation with a fluid, e.g. a preservative, in a high-pressure environment. Here, a method is put forward allowing a comparatively large amount of fluid to be added to the structure of the wood by combining steps of heating by electromagnetic radiation, vacuum treatment, and high-pressure treatment.

OBJECTS OF THE INVENTION

An object according to the present invention is to provide a method for adding a fluid to the internal structure of wood. A particular feature of the present invention is that a heating subsequent to supplying the fluid to the wood enables a higher amount of fluid to be added to the internal structure of the wood. An advantage with the present invention is that it enables a comparatively large amount of preservation liquid to be added to the wood. Another object according to the present invention is to provide a method for treating wood with heat, e.g. for the purpose of reducing the water contents of the wood, enabling a larger amount of fluid to be added to the wood. Another particular feature of the present invention is that it allows for a fluid and/or heat treatment without causing warping of the wood.

SUMMARY/DISCLOSURE OF THE INVENTION

In addition to the above objects, the above advantages and the above features, numerous other objects, advantages and features will be evident from the general and detailed descriptions given below of preferred embodiments according to the present invention. The objects, advantages and features are according to a first aspect of the present invention obtained by a method for fluid treatment of wood comprising the steps of placing the wood in an airtight tank, evacuating the airtight tank to establish a vacuum environment for the wood, applying a fluid to the wood.

When the vacuum environment is established, there will be a pressure difference between the interior of the wood and the vacuum environment. Natural fluids, e.g. water and air, will be expelled from within the wood because of the pressure difference, in which natural pathways and vessels for fluids within the wood may be cleared from obstacles, enabling an easier flow for a fluid back into the wood. Further, the pressure difference may create microscopic raptures in the structure of the wood, which will enable a fluid to reach part of the wood otherwise unreachable. These processes continue until the internal pressure in the wood is in equilibrium with the pressure of the vacuum environment. As the amount of natural fluids within the wood is lowered, the affinity of the wood to absorb another fluid is increased significantly.

When the fluid is added to the wood in the vacuum environment, the fluid can reach and fill cavities of the wood structure otherwise filled gas or a liquid that is natural to the wood. This is a clear advantage, as the penetration of the fluid is increased, thereby giving a higher amount of liquid within the structure of the wood.

The wood may constitute several pieces, e.g. a baulk, a plank or board, a heartwood or sapwood board, a trimmed or untrimmed board, the slab or the outside board, half or quarter timber, and/or a board with a wane. Further, the wood may be arranged so that a flat side of one piece of wood is juxtaposing a flat side of another piece of wood. The wood may be stacked in several layers, where the wood pieces in each layer define a common lengthwise direction. The common lengthwise direction may be the same for all layers, or it may be perpendicular for neighbouring layers.

The airtight tank may have the form of a cylinder with convex end-caps. Here, airtight may be understood as having the ability to sustain both a vacuum environment and a pressurized environment for an extended period of time. Naturally, the airtight tank may have a door, or a contraption with a similar function, for enabling a repeated placing or removal of stacked wood in the tank. As the tank shall sustain a pressurized environment, measures may have to be taken to seal the door to the tank, e.g. by nuts and bolts, especially if the door opens outwards from the interior of the airtight tank.

It should be emphasized that the fluid may be a liquid or a gas, but preferably a liquid.

The method according to the first aspect of the present invention may further comprise the step of pressurizing the airtight tank to establish a pressurized environment for the wood, wherein the step of pressurizing is simultaneous to and/or subsequent to the step of applying a fluid. A pressurized environment may have a pressure that is equal to or greater than the pressure of the ambient atmosphere. With an increased pressure from the pressure of the vacuum environment, the fluid will be forced into the cavities of the wood structure, by which a higher saturation of the wood can be reached. Naturally, the higher the pressure, the more fluid will be forced into the wood. It is possible that the proposed process will reach an over-saturation, so that the fluid will be expelled from the wood when the pressure of the pressurized environment is equalized with that of the ambient atmosphere.

The method according to the first aspect of the present invention may further comprise step of subjecting the wood to a subsequent heating by electromagnetic radiation through one or more electrodes, wherein the subsequent heating is simultaneous to and/or subsequent to the step of applying a fluid. If the step of pressurizing the airtight tank is performed, the subsequent heating may be prior to, simultaneously to, and/or subsequent to the pressurizing. For the case of the fluid being a liquid, the heating of the wood may have the advantage that the liquid within the wood is heated, whereby the viscosity of the liquid decreases, and the liquid can penetrate even further into the wood structure. Naturally, this effect may also be obtained by a preheating of the liquid. However, this may have the disadvantage that the vapour pressure of the liquid is greater when it enters the vacuum environment, which makes it harder to maintain the desired vacuum. The subsequent heating may also increase the internal pressure in the wood, which may force the liquid into cavities it has not reached.

For the case of the fluid being a liquid, the liquid may be a substance that can be cured by heating, which increases its viscosity significantly. Naturally, for this kind of liquids, a preheating may be very unfavourable, since the increased viscosity reduces the liquids' ability to penetrate into the structure of the wood. By the proposed method, wood can be saturated or infused by liquid, which is then cured within the wood structure by heating.

The method of treating wood may further comprise the step of subjecting the wood to a prior heating by electromagnetic radiation through one or more electrodes, wherein the prior heating is prior to and/or simultaneous to the step of applying a fluid. This prior heating may be prior to, simultaneously to, and/or subsequent to the step of evacuating the airtight tank. The prior heating may have the advantage that it increases the internal pressure of wood relative to pressure of the vacuum environment. Thereby, natural fluids, e.g. water and air, may be expelled from within the wood because of the pressure difference, in which natural pathways and vessels for fluids within the wood may be cleared from obstacles, enabling an easier flow for a fluid back into the wood. Further, the pressure difference may create microscopic raptures in the structure of the wood, through which natural fluids may escape, and other fluids enter. As the amount of natural fluids within the wood is lowered, the affinity of the wood to absorb another fluid is increased. The prior heating may be particularly favourable when performed in a vacuum environment, as the low pressure more or less may have the same effect on the wood as the prior heating, making the two steps work in conjunction. Further, the vacuum environment also lowers the boiling point of the expelled natural liquids, making them easier to remove from the airtight tank by the action of the vacuum pump.

The one or more electrodes employed in the subsequent heating and the one or more electrodes employed in the prior heating may be the same. Alternatively, some or all of the electrodes may not be the same.

The vacuum environment may define a prior gas pressure prior to applying the fluid and a subsequent gas pressure simultaneous to and/or subsequent to applying the fluid, and the ratio of the subsequent gas pressure over the prior gas pressure may be in the range of approximately 1 to approximately 2. By limiting the increase of the pressure this way, it is ensured the natural fluids, in particular air and water vapour, is not pressed back into the structure of the wood, which would hinder the fluid to reach the cavities within the wood.

The pressurized environment may have a gas pressure in the range of approximately 1 bar to approximately 12 bar, which has been found to be a particularly favourable parameter range when performing the proposed method for fluid treatment according to the first aspect of the invention.

The wood may be completely immersed in the fluid, which may have that advantage that the fluid can enter the wood from all sides. For the case of machined wood, e.g. sawed, planed, or lathed wood, openings of capillaries and natural pathways for fluids can be found on all machined surfaces of the wood. Further, the machining may create small or microscopic raptures at every machined surface of the wood. Hence, more fluid may enter the wood structure through its natural pathways and microscopic raptures when the wood is completely submerged in the fluid. Alternatively, for the case of the fluid being a liquid, the wood may be immersed in the liquid so that the machined surfaces of the wood are below the surface of the liquid.

The fluid may be stored in a reservoir interconnected with the airtight tank. This has the advantage that it enables the airtight tank to be free from the fluid when evacuating, where, if the fluid is a liquid, vapour from the liquid otherwise would make the vacuum environment harder to obtain. Further, it also has the advantage that the prior heating can be performed without any fluid within the airtight tank the, which may otherwise have several drawbacks. For example, a liquid may harden with a reduced viscosity, or start to boil to make an established vacuum harder to maintain. Additionally the reservoir may be pressurized for establishing and/or increasing the flow of fluid from the reservoir to the airtight tank. If the fluid is a liquid, this may be a particular advantage if the viscosity of the liquid is high. Additionally, the pressure established in the reservoir may be employed in the subsequent step of pressurizing the airtight tank.

The fluid may be a preservation fluid, a dye, or a particular chemical compound or mix of chemical compounds. As an example, the fluid may be a 20% solution of dinatriumoctaborat-tetraborat in monoetylenglycol, or it may be a linseed oil based paint. Alternatively, the fluid may be liquid water, supplied for increasing the water contents of the wood.

The objects, advantages and features are according to a second aspect of the present invention obtained by a method for heat treatment of wood comprising the steps of placing the wood in an airtight tank, evacuating the airtight tank to establish a vacuum environment for the wood, and subjecting the wood to a heating by electromagnetic radiation through one or more electrodes. A direct advantage of this method may be that the water content of the wood is lowered. This is achieved by the combined vacuum environment and heating. Both of these will contribute to increase the pressure difference between the interior of the wood and the interior of the airtight tank. Natural fluids, e.g. water and air, will be expelled from within the wood because of the pressure difference, in which natural pathways and vessels for fluids within the wood may be cleared from obstacles, enabling an easier escape of natural fluids from the wood. Further, the pressure difference may create microscopic raptures in the structure of the wood, through which the natural fluids may escape. These processes continue until the internal pressure in the wood is in equilibrium with the pressure of the vacuum environment. The heating in itself may be an advantage, as it may change the structural and chemical properties of the wood, which in turn may make the wood less appetizing for insects, or may give the wood a more favourable moisture equilibrium.

The methods according to the first and the second aspects of the present invention may have several additional features or elements. The vacuum environment may have a gas pressure in the range of approximately 0.04 bar to approximately 0.1 bar. This pressure range has been shown to be particularly favourable for both the fluid and the heat treatment.

The wood may comprise a plurality of layers, and an electrode of the one or more electrodes is placed between two neighbouring layers of the plurality of layers. This allows for the placing of an electrode within the body of stacked wood pieces. As the electromagnetic radiation is normally the strongest closest to the emitting electrode, this may make the heating more efficient. Further, the placing of several electrodes within the body of stacked wood pieces can be optimized so that a homogeneous heating is obtained, i.e. all wood pieces are subjected to essentially the same heating. The electrodes may be of a rectangular shape and placed in coplanar relationship with the layers of wood, or they may have a narrow elongated shape. Additionally or alternatively, the wood may comprise a plurality of layers, and an electrode of the one or more electrodes may be placed between every two neighbouring layers of the plurality of layers, which enables a homogeneous and efficient heating. The electrodes may have the additional function of spacers between the plurality of layers. Further, the electrodes may define a rectangular surface being essentially equal to, or smaller than, the planar surface defined between two neighbouring layers of wood.

The one or more electrodes may constitute two groups of electrodes having opposite polarities. One advantage with this particular feature may be that unwanted resonances in the electrodes and the associated power/frequency supply, as well as within the confined space of an electrically conducting airtight tank, can be avoided or reduced. Naturally, resonances also depend on the geometric placing in the three-dimensional body of the stacked wood pieces, as well as the shape of the electrodes and the airtight tank. Further, having electrodes of opposite polarities may result in currents going through the wood, which will cause resistive heating of the wood in addition to the heating from the electromagnetic radiation. Additionally or alternatively, two neighbouring electrodes of the one or more electrodes may have opposite polarities. One advantage with this particular feature is that it increases the probability of currents to pass through wood, especially if the airtight tank and the supports for the wood are earthed. Electrodes having opposite polarities may be placed with a wood piece between them, which will give a particularly efficient heating of this wood piece. If all electrodes have the same polarity and the, there is a high probability that the currents follow the path of the least resistance to ground, which may not be favourable for resistive heating.

The electromagnetic radiation may have a frequency in the range of approximately 10 to approximately 30 MHz, and preferably a frequency of approximately 13.56 MHz or approximately 27.12 MHz. It has been shown that the heating of wood is particularly efficient at these frequencies.

The methods according to the first and the second aspects of the present invention may further comprise the step of establishing a mechanical pressure on the wood by a compression system for preventing deformation of the wood. This particular step may be prior, simultaneous, or subsequent to any of the earlier mentioned steps of the suggested methods. The step of establishing a mechanical pressure may be prior to a prior heating, and/or prior the step of applying a fluid. Additionally or alternatively, the mechanical pressure may be maintained to a point in time being subsequent to a subsequent heating. One advantage of the mechanical pressure is that it prevents warping of the wood when it is treated, in particular by heating. Another advantage with the mechanical pressure may be that the structural properties of the wood, e.g. the tensile strength, are improved. Further, the mechanical pressure may be employed for decreasing the volume of the wood. It has been shown that it is possible to achieve a compression of the wood of up to 50% in one of its physical dimensions. Preferably the compression has a direction perpendicular to the general direction of the fibres of the wood.

The wood may be arranged to define a flat side, and the compression system comprises a flat compression plate for distributing the mechanical pressure over parts of, or the whole of, the flat side. This particular feature has the advantage that it may prevent warping of the wood in one dimension. Preferably, the flat compression plate is parallel to the general direction of the fibres of the wood. Additionally or alternatively, the wood may be arranged to define four flat sides at right angles, and the compression system comprises a plurality of flat compression plates for establishing the mechanical pressure through the four flat sides. As an example, a pair of horizontal compression or support plates defines a mechanical pressure component in the wood having an essentially vertical normal, while a pair of vertical compression or support plates defines a mechanical pressure component in the wood having a horizontal normal. This particular feature has the advantage that it allows for a prevention of warping in two dimensions of the wood. Preferably, the flat compression plates are parallel to the general direction of the fibres of the wood.

The compression system may comprise a clamp for establishing a part of, or the whole of, the mechanical pressure. This feature allows for a mechanical pressure that does not depend on any permanently mounted devices on the airtight tank. For example, the clamps can be employed to the wood before it is placed in the airtight tank and removed first after the completion of one of the abovementioned treatment methods. Alternatively, the clamps may be removed a couple of hours, a couple of days, or a couple of weeks after the completion. Thereby, warping of the wood can be prevented for an extended period of time, without occupying the airtight tank.

As an alternative or addition to the clamps, the compression system may comprise a hydraulic or pneumatic compressor for providing the mechanical pressure. This has the advantage that the mechanical pressure can be varied during the treatment of the wood. Shrinkage or expansion of the wood is common phenomena in wood treatment, and a compression system involving hydraulics or pneumatics can adjust to these effects. For example, if the wood shrinks, a flat compression plate can be moved to maintain physical contact with the wood, which enables a constant mechanical pressure.

Further, at least one flat compression plate may additionally have the function of an electrode of the one or more electrodes. This feature may present an advantage if heating from the boundaries of the wood is preferred, e.g. if the wood only defines a small number of layers, or a single layer.

The compression system may comprise a pneumatic vacuum pump for providing the mechanical pressure and additionally for evacuating the airtight tank. Additionally or alternatively, the compression system may comprise an inflatable bag for establishing and distributing the mechanical pressure, or wherein the compression system alternatively comprises a piston or bellow for establishing the mechanical pressure.

One aim of the present invention is to provide a new multi-step process for the curing and drying of a product, in particular wood. In the individual steps the wood is subjected to: [1] an alternating magnetic field, [2] high-frequency radio emission and [3] microwave radiation. In step [2] and [3] the wood element may be placed inside a vacuum tank. The steps are performed in the said order; however, one or more of those may be excluded from the process.

The advantage with this new process over prior art is that it provides a more efficient and uniform heating of wood, thereby shortening the time needed for curing or drying, without any negative structural effects on the final product. The process can be optimized for different wood properties—such as dimensions, water contents and reinforcement spacing—by varying the time and the applied power in each of the steps above. Further, the frequency of the induction fields in step [1] and [2], i.e. the magnetic and high frequency radio fields, can be varied to achieve a more favourable heating for curing and drying.

For the case of steel-bar reinforcements placed close to the centre of a product, the magnetic induction [1] will heat the element from its centre. The high-frequency radio emission [2] will induce heating, both through electromagnetic induction in the reinforcements and by direct dielectric heating of the product. The former will heat the elements from its centre, while for the latter the heating is the strongest at the surface of the element. The microwave radiation [3] will induce dielectric heating that is the strongest close to the surface. Clearly, even though being a very inhomogeneous medium, the temperature of a steel-bar reinforced product can be increased uniformly by the above-suggested multi-step process.

For other kinds of reinforcements, such as small fibres, hooks and rings, that are evenly spread throughout the product and manufactured of an electrically conductive material, such as steel or carbon, the heating in step [1] and [2] can be distributed in a more uniform fashion, making one of the steps obsolete.

From a slightly different perspective, one aim of the present invention is to provide a new method for the drying of a product by subjecting it to high-frequency radio emission in a vacuum environment. The advantage with this new process over prior art is that it provides a more efficient drying, thereby shortening the time needed for the process. The process can be optimized for different product properties—such as dimensions, water contents, metal contents, and presence of metal pieces—by varying the time and applied power of the heating. Further, the frequency of the high-frequency radio emission can be varied to achieve a more favourable heating.

If there are metal components in a product, the high-frequency radio emission will induce heating both through electromagnetic induction in the metal and by direct dielectric heating. The former will heat the product from where metal components are situated, while for the latter the heating is the strongest at the surface of the product. The metal components can be small objects, such as fibres, hooks and rings which can be evenly spread throughout the product, thereby distributing the heating in a more uniform fashion.

BRIEF DESCRIPTION OF THE DRAWINGS

Additional objects and features according to the present invention will be more readily apparent from the following detailed description and appended claims, where the former is presented in conjunction with the drawings:

DETAILED DESCRIPTION OF THE INVENTION

Figure 1:
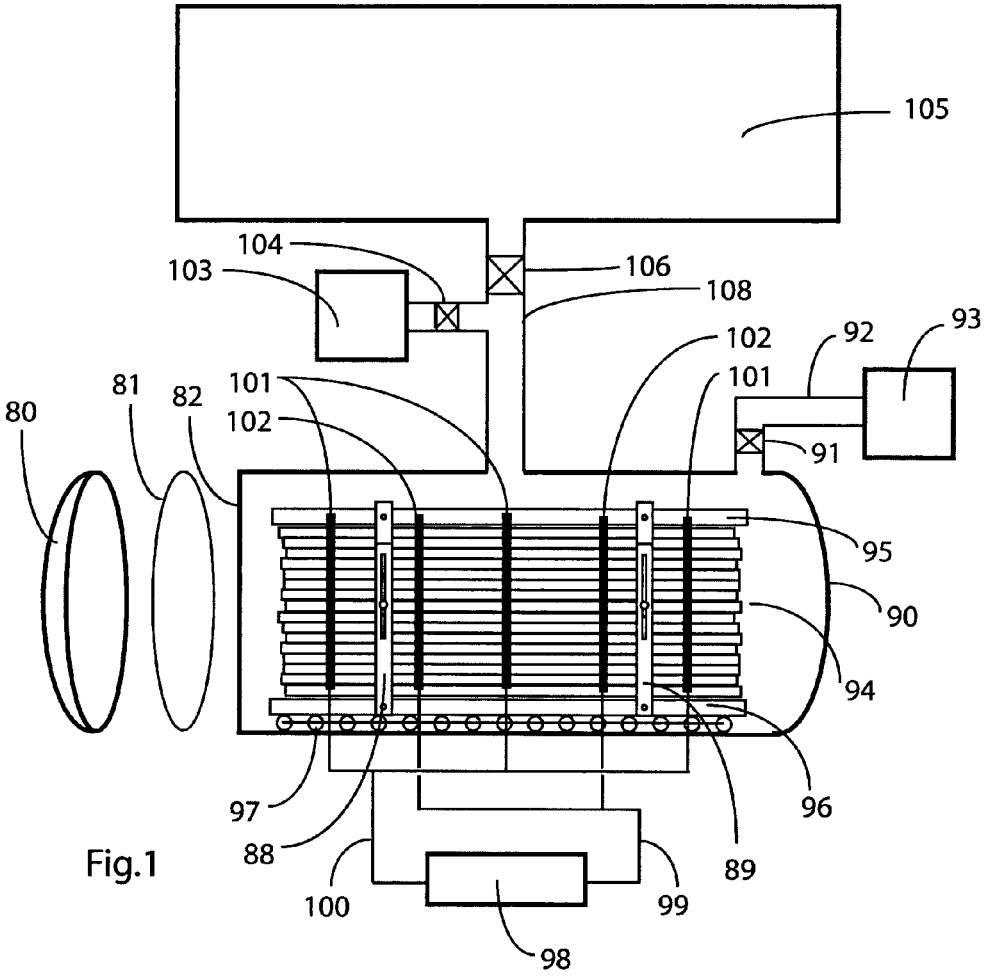
FIG. 1 illustrates a first and preferred embodiment of the method for a fluid treatment of wood.

A cross-sectional view of a first arrangement for drying wood according to a presently preferred embodiment of the invention is shown FIG. 1. A batch of stacked wood in the form of boards 94 is placed within a tank 90 through an opening for loading 82. The batch of stacked wood defines an upper flat side against which a flat upper support plate 95 rests. Similarly, the batch of stacked wood defines a lower flat side resting against a flat lower support plate 96. Inside the tank 90 the lower support plate in turn rests on a roller conveyer 97, allowing the batch of wood to slide into the tank 90.

The tank 90 can be sealed off from the ambient by way of a tank door 80 and an o-ring 81 being placed over the opening for loading 82. An outflow tube 92 connects the airtight tank 90 to pneumatic vacuum pump 93, whereby a vacuum can be established inside the airtight tank 90. An outflow valve 91 is placed in the outflow tube 92 to allow the tank 90 to maintain lower than atmospheric pressure even though the vacuum pump 93 is turned off. A closed outflow valve 91 will also allow the tank 90 to be opened without putting too much strain on an active pneumatic vacuum pump 93. The pressure inside the airtight tank 90 can be lowered to within a typical range of approximately 10 mmHg to approximately 100 mmHg.

The flat upper support plate 95 and the lower support plate 96 are connected by clamps 88 and 89 establishing a compression force acting to bring the two support plates 95 and 96 together. The compression force is subsequently converted as a mechanical pressure over the upper and lower sides of the batch of stacked wood, which will counteract deformations, such as twisting and bending, of the wood boards 94 while they are treated by the proposed method. The clamps 88 and 89, and the upper 95 and lower 96 support plates constitute a compression system for preventing deformations of the wood when drying.

Two groups of electrodes have been placed in vertical orientation next to the batch of stacked wood, and/or between columns defined by the boards 94. The groups of electrodes are connected to a HF-generator 98 by cables 99 and 100 so that, when operating the generator 98, the first group 101 has a polarity being opposite to that of the second group 102. The electrodes are arranged so that two neighbouring electrodes have opposite polarity. The electrodes 101 and 102, the associated cables 99 and 100, and the HF-generator 98 constitutes an electrode system, which is suitable for producing electromagnetic radiation in the frequency range of approximately 10 MHz to approximately 30 MHz.

A reservoir 105 for a preservation fluid is interconnected with the tank 90 by way of an inflow tube 108. A reservoir valve 106 controls the flow of preservation fluid from the reservoir 105. In this particular embodiment, the preservation fluid is a liquid and the flow is achieved by hydrostatic pressure within the reservoir 105. With an open reservoir valve 106 the preservation liquid will flow through the inflow tube 108 to the tank 90, thereby reaching the wooden boards 94. A compressor 103 is interconnected with the inflow tube 108 through a compressor valve 104. The compressor 103 can establish a pressurized environment, preferably having a fluid pressure of approximately 1 bar to approximately 12 bar, inside the tank 90.

In a preferred preservation treatment, the tank 90 is first evacuated by the vacuum pump 93 to a pressure in the range of approximately 10 to approximately 40 mmHg. When this pressure is established, the wood 94 rests in the vacuum environment to expel some of its natural fluids contained within its structure, after which it is subjected to heating by electromagnetic radiation from the electrodes 101 and 102. Preservation liquid is then discharged from the reservoir 105 to the tank 90 by opening the reservoir valve 106, thereby reaching the boards 94, during which the gas pressure within the tank 90 is held within the range of approximately 10 to approximately 40 mmHg, alternatively within the range of approximately 0.04 bar and approximately 0.1 bar. The discharge is terminated by closing the reservoir valve 106 after the boards 94 have been completely immersed in the liquid. The essential feature here is that the liquid is supplied to the wood 94 in a vacuum environment. The valve 91 to the vacuum pump 93 is closed, and the reservoir valve 106 is opened to allow pressure equalization by the liquid. The reservoir valve 106 is closed and the compressor valve 104 is open to allow the compressor 103 to establish a pressurized environment in the range of approximately 1 bar to approximately 12 bar. The described presently preferred embodiment can yield a concentration of preservation fluid in the wood that is up to about 20 times higher than what is possible by conventional methods.

Figure 2:
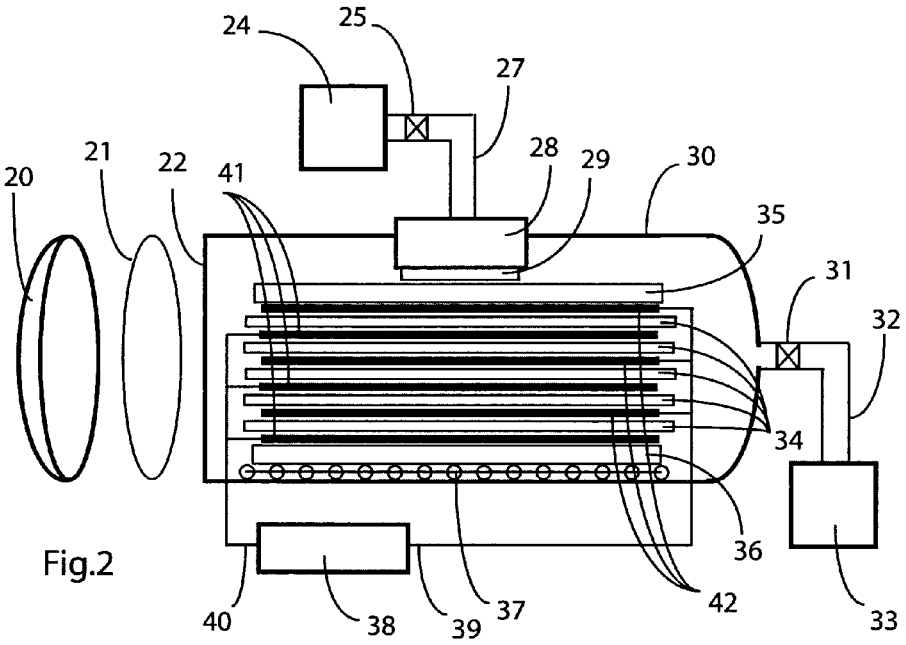
FIG. 2 illustrates a second embodiment of the method for drying wood.

A cross-sectional view of a second arrangement for drying wood according to a particular embodiment of the invention is shown in FIG. 2. A batch of stacked wood in the form of boards 34 is placed within a tank 30 through an opening for loading 22. The batch of stacked wood defines an upper flat side against which a flat upper support plate 35 rests. Similarly, the batch of stacked wood defines a lower flat side resting against a flat lower support plate 36. Inside the tank 30 the lower support plate in turn rests on a roller conveyer 37, allowing the batch of wood to slide into the tank 30.

The tank 30 can be sealed off from the ambient by way of a tank door 20 and an o-ring 21 being placed over the opening for loading 22. An outflow tube 32 connects the airtight tank 30 to pneumatic vacuum pump 33, whereby a vacuum can be established inside the airtight tank 30. An outflow valve 31 is placed in the outflow tube 32 to allow the tank 30 to maintain lower than atmospheric pressure even though the vacuum pump 33 is turned off. A closed outflow valve 31 will also allow the tank 30 to be opened without putting too much strain on an active pneumatic vacuum pump 33. The pressure inside the airtight tank 30 can be lowered to within a typical range of approximately 10 mmHg to approximately 100 mmHg.

A hydraulic compression system is defined by a piston 29, a cylinder 28 attached to the wall of the tank 30, a tube 27 and a hydraulic compressor 24. The piston is connected to the flat upper support plate 35 and when activating the hydraulic compressor 24 the established hydraulic pressure is converted to a mechanical pressure over the upper side of the batch of stacked wood. This mechanical pressure will counteract deformations, such as twisting and bending, of the wood boards 34 while being treated.

Two groups of electrodes have been inserted into the batch of stacked wood. The groups of electrodes are connected to a HF-generator 38 by cables 39 and 40 so that, when operating the generator 38, the first group 41 has a polarity being opposite to that of the second group 42. The electrodes are arranged so that two neighbouring electrodes have opposite polarity. The electrodes 41 and 42, the associated cables 39 and 40 and the HF-generator 38 constitutes an electrode system, which is suitable for producing electromagnetic radiation in the frequency range of approximately 10 MHz to approximately 30 MHz.

When operating the second arrangement for drying wood according to this particular embodiment, the wood is placed inside the tank 30, a vacuum is established by way of the vacuum pump 33, the wood is subjected to a mechanical pressure by way of the compression system, and the wood is heated by subjecting it to electromagnetic radiation through the electrode system.

Figure 3:
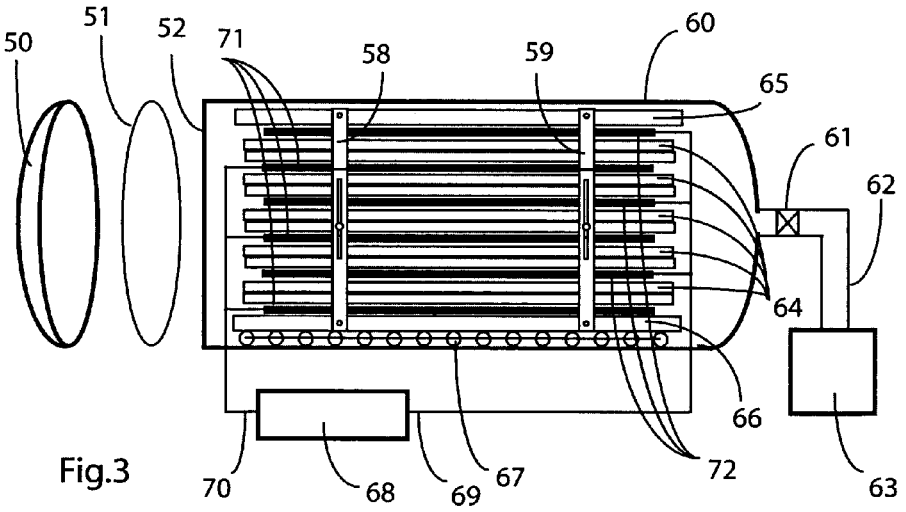
FIG. 3 illustrates a third embodiment of the method for drying wood.

A cross-sectional view of a third arrangement for drying wood according to a particular embodiment of the invention is shown in FIG. 3. A batch of stacked wood in the form of boards 64 is placed within a tank 60 through an opening for loading 52. The batch of stacked wood defines an upper flat side against which a flat upper horizontal support plate 65 rests. Similarly, the batch of stacked wood defines a lower flat side resting against a flat lower horizontal support plate 66. Inside the tank 60 the lower support plate in turn rests on a roller conveyer 67, allowing the batch of wood to slide into the tank 60.

The tank 60 can be sealed off from the ambient by way of a tank door 50 and an o-ring 61 being placed over the opening for loading 52. An outflow tube 62 connects the airtight tank 60 to pneumatic vacuum pump 63, whereby a vacuum can be established inside the airtight tank 60. An outflow valve 61 is placed in the outflow tube 62 to allow the tank 60 to maintain lower than atmospheric pressure even though the vacuum pump 63 is turned off. A closed outflow valve 61 will also allow the tank 60 to be opened without putting too much strain on an active pneumatic vacuum pump 63. The pressure inside the airtight tank 60 can be lowered to within a typical range of approximately 10 mmHg to approximately 100 mmHg.

The flat upper support plate 65 and the lower support plate 66 are connected by clamps 58 and 59, which establish a compression force acting bringing the two support plates 65 and 66 together. The compression force is subsequently converted as a mechanical pressure over the upper and lower sides of the batch of stacked wood, which will counteract deformations, such as twisting and bending, of the wood boards 64 while being heated and dried. The clamps 58 and 59, and the upper 65 and lower 66 support plates constitute a compression system for preventing deformations of the wood when drying. In an alternative embodiment there are additional vertical support plates able to provide a mechanical pressure with an essentially horizontal normal.

Two groups of electrodes have been inserted into the batch of stacked wood. The groups of electrodes are connected to a HF-generator 68 by cables 69 and 70 so that, when operating the generator 68, the first group 71 has a polarity being opposite to that of the second group 72. The electrodes are arranged so that two neighbouring electrodes have opposite polarity. The electrodes 71 and 72, the associated cables 69 and 70, and the HF-generator constitutes an electrode system, which is suitable for producing electromagnetic radiation in the frequency range of approximately 10 MHz to approximately 50 MHz.

When operating the third arrangement for drying wood according to this particular embodiment, the wood is placed inside the tank 60, a vacuum is established by way of the vacuum pump 63, the wood is subjected to a mechanical pressure by way of the compression system, and the wood is heated by subjecting it to electromagnetic radiation through the electrode system.

Figure 4:
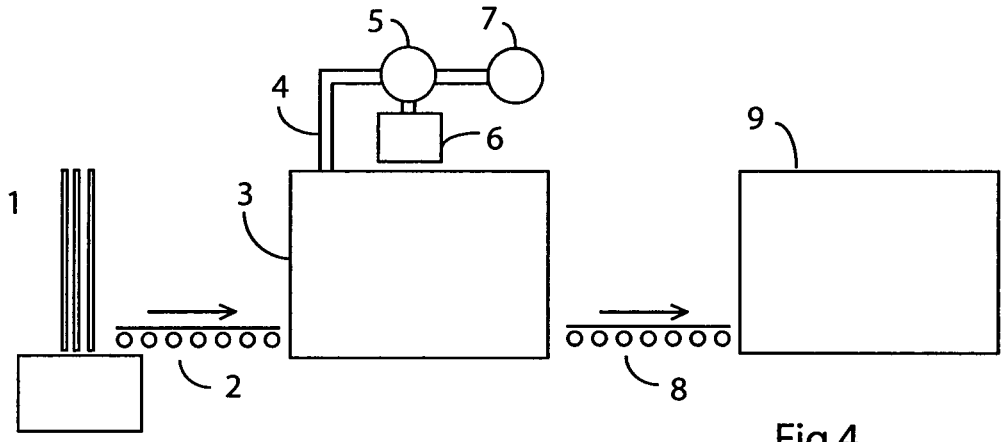
FIG. 4 schematically outlines a preferred method of drying.

To give an alternative a principal description of the proposed method, a schematic illustration of the process is outlined in FIG. 4.

The first part in the multi-step process is an induction unit 1 with a variable output frequency and power. Alternatively, the output frequency is fixed. The unit 1 is equipped with a coil design suitable for the magnetic inductive heating, e.g. a helix surrounding the product. The frequency of the variable magnetic field is typically in the range 20 to 150 kHz. After the initial heating—corresponding to step [1] above—a conveyor belt, a cart system or a similar arrangement 2 moves the product further in the process.

The second part of the process is a high-frequency radio unit 3 with a variable output power and frequency, where the former is at least 30 kW, or more preferably at least 1 kW, and the latter is typically in the range 3 to 30 MHz, or most preferably 13.56 MHz. The unit 3 has an electrode design and a configuration suitable for inductive and dielectric heating of the product. The electrodes are placed inside a sealable airtight tank, where the heating of the product takes place. The purpose with the tank is twofold, namely to contain the radio emission and to provide the housing for a low-pressure environment.

A vacuum pump 7 lowers the pressure inside chamber 3 through a piping system 4. The moisture and air, which is discharged from the product inside 3, will be removed through the same piping system. To prevent the moisture from reaching the vacuum pump 7, a dryer 5 separates the water from the air. The water is then led from the dryer 5 to be collected in a container 6, from where it can be recycled. After the high-frequency radio heating and the vacuum treatment—corresponding to step [2] above—a conveyor belt, a cart system or a similar arrangement 8 moves the product to next step in the process.

The third part of the process is a microwave unit 9, which has a construction suitable for the heating of the product. An example to this can be a configuration where a set of magnetrons simultaneously illuminates the product from several different directions. A typical frequency of the microwave radiation is in the range 0.3 to 30 GHz, or most preferably 900 MHz. The unit 9 is shielded so that no hazardous microwave radiation can escape to the surroundings. Heating in 9 corresponds to step [3] above.

To conclude the description, in each of the three steps the heating of the product is supplied through different electromagnetic phenomena, without any physical contact between the actual heating elements—such as coils and electrodes—and the product. The cited frequencies above are given to clarify the description. It is understood that the proposed multistep method will work also for frequencies that deviate significantly from the stated values.

It is also understood that the inductive heating in step [1] and [2] must not necessarily be applied through electrically conductive elements inside a product. The inductive heating can instead be applied through an electrically conductive material, e.g. a metal form, which is in contact with or in close proximity to the product. Examples of products for which the proposed process can be applied are wood, grain and bricks.

Figure 5:
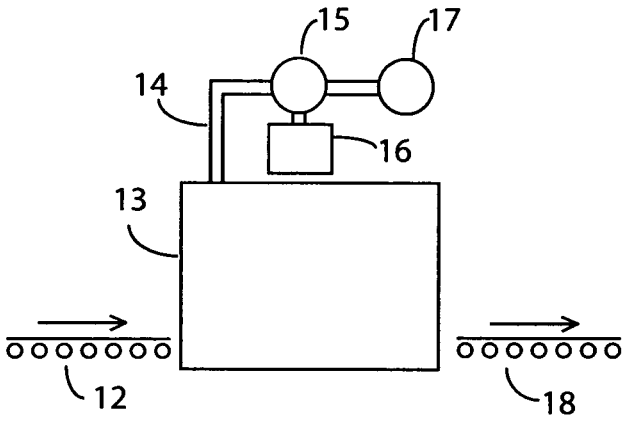
FIG. 5 schematically outlines another preferred method of drying.

To give an alternative another principal description of the proposed method, a schematic illustration of the process is outlined in FIG. 5.

A conveyor belt, a cart system or a similar arrangement 12 moves the product to the high-frequency radio unit 13, which has a variable output power and frequency, where the former is at least 30 kW, or more preferably at least 1 kW, and the latter is typically in the range 3 to 30 MHz, or most preferably 13.56 MHz. The unit 13 has an electrode design and a configuration suitable for inductive and dielectric heating of the said products. The electrodes are placed inside a sealable airtight tank, where the heating of the products takes place. The purpose with the tank is twofold, namely to contain the radio emission and to provide the housing for a low-pressure environment.

A vacuum pump 17 lowers the pressure inside chamber 13 through a piping system 14. The moisture and air, which is discharged from the products inside 13, will be removed through the same piping system. To prevent the moisture from reaching the vacuum pump 17, a dryer 15 separates the water from the air. The water is then led from 15 to be collected in a container 16, from where it can be recycled. After the high-frequency radio heating and the vacuum treatment a conveyor belt, a cart system or a similar arrangement 18 moves the products further.

To conclude the description, the product is heated by an electromagnetic phenomenon, without any physical contact between the actual heating elements—such as coils and electrodes—and the product. The cited frequencies above are given to clarify the description. It is understood that the proposed drying method will work also for frequencies that deviate significantly from the stated values.

Examples of products for which the proposed method can be applied are wood, grain and bricks. It is understood that the inductive heating must not necessarily be applied through electrically conductive components inside a product, such as the steel bars inside reinforced concrete. The inductive heating can instead be applied through an electrically conductive material, e.g. a metal form, which is in contact with or in close proximity to the product.

ITEM LIST

1 induction unit
2 conveyor belt
3 high-frequency radio unit
4 piping system
5 dryer
6 container
7 vacuum pump
8 cart system
9 microwave unit
12 conveyor belt
13 high-frequency radio unit
14 piping system

15 dryer
16 container
17 vacuum pump
18 cart system
20 tank door
21 o-ring
22 opening for loading
24 hydraulic compressor
25 compressor valve
26 inflow valve
27 inflow tube
28 cylinder
29 piston head
30 tank
31 vacuum pump valve
32 outflow tube
33 vacuum pump
34 wood boards
35 upper support plate
36 lower support plate
37 roller conveyer
38 HF-generator
39 first polarity cables
40 second polarity cables
41 first polarity sandwich electrodes
42 second polarity sandwich electrodes
50 tank door
51 o-ring
52 opening for loading
58 clamp
59 clamp
60 tank
61 vacuum pump valve
62 outflow tube
63 vacuum pump
64 wood boards
65 upper support plate
66 lower support plate
67 roller conveyer
68 HF-generator
69 first polarity cables
70 second polarity cables
71 first polarity sandwich electrodes
72 second polarity sandwich electrodes
80 tank door
81 o-ring
82 opening for loading
88 clamp
89 clamp
90 vacuum tank
91 vacuum pump valve
92 outflow tube
93 vacuum pump
94 wood boards
95 upper support plate
96 lower support plate
97 roller conveyer
98 HF-generator
99 first polarity cables
100 second polarity cables
101 first polarity sandwich electrodes
102 second polarity sandwich electrodes
103 compressor
104 compressor valve
105 preservation fluid reservoir
106 reservoir valve
108 inflow tube

The invention claimed is:

1. A method for fluid treatment of wood comprising the steps of:

(a) placing said wood in an airtight tank, (b) evacuating said airtight tank to establish a vacuum environment for said wood using a vacuum pump for pumping the air out of the airtight tank via an outflow valve, placed in an outflow tube between the airtight tank and the vacuum pump, (c) applying a preservation liquid and/or dye to said wood by supplying the liquid and/or dye from a reservoir interconnected with the airtight tank and the reservoir, while the vacuum environment is maintained within the airtight tank, wherein said wood is completely immersed in said preservation liquid and/or dye, (d) pressurizing said airtight tank to establish a pressurized environment for said wood using a compressor that is connected to the airtight tank through a compressor valve placed between the compressor and the airtight tank, and (e) heating said wood by electromagnetic radiation through one or more electrodes, using a HF-generator that is connected to the one or more electrodes via one or more cables, wherein said heating is performed while said wood is immersed in said preservation liquid and/or dye.

2. The method according to claim 1, wherein said heating is performed simultaneously to, subsequent to, or both, said applying a preservation liquid and/or dye around said wood.

3. A method for fluid treatment of wood comprising the steps of:

placing said wood in an airtight tank, and then evacuating said airtight tank to establish a vacuum environment for said wood using a vacuum pump for pumping the air out of the airtight tank via an outflow valve, placed in an outflow tube between the airtight tank and the vacuum pump, and then heating said wood by electromagnetic radiation through one or more electrodes, using a HF-generator that is connected to the one or more electrodes via one or more cables, while the vacuum environment is maintained within the airtight tank, applying a preservation liquid and/or dye to said wood by supplying the preservation liquid and/or dye from a reservoir interconnected with the airtight tank and the reservoir, while the vacuum environment is maintained within the airtight tank, wherein said wood is completely immersed in said preservation liquid and/or dye, and then pressurizing said airtight tank to establish a pressurized environment for said wood using a compressor that is connected to the airtight tank through a compressor valve placed between the compressor and the airtight tank, wherein said heating is performed simultaneously to, subsequent to, or both, said applying a preservation liquid and/or dye to said wood and while said wood is immersed in said preservation liquid and/or dye.

4. The method according to claim 3, wherein said vacuum environment defines a prior gas pressure prior to applying said liquid and a subsequent gas pressure subsequent to applying said liquid, whereby the ratio of said subsequent gas pressure over said prior gas pressure is in the range of approximately 1 to approximately 2.

5. The method according to claim 3, wherein said pressurized environment has a gas pressure in the range of approximately 1 bar to approximately 12 bar.

6. The method according to claim 3 wherein said reservoir is pressurized for establishing and/or increasing the flow of liquid from said reservoir to said airtight tank.

7. The method according to claim 3, wherein said vacuum environment has a gas pressure in the range of approximately 0.04 bar to approximately 0.1 bar.

8. The method according to claim 3, wherein said electromagnetic radiation has a frequency in the range of approximately 10 to approximately 30 MHz.

9. The method according to claim 3, wherein said electromagnetic radiation has a frequency of approximately 13.56 MHz or approximately 27.12 MHz.

10. A method for liquid treatment of wood comprising the steps of placing said wood in an airtight tank, establishing a mechanical pressure on said wood by a compression system for preventing deformation of said wood, wherein said wood is arranged to define a flat side, and said compression system comprises flat compression plate for distributing said mechanical pressure over parts of, or the whole of said flat side, and wherein the flat compression plate additionally has the function of an electrode, and then evacuating said airtight tank to establish a vacuum environment for said wood using a vacuum pump for pumping the air out of the airtight tank via an outflow valve, placed in an outflow tube between the airtight tank and the vacuum pump, and then heating said wood by electromagnetic radiation through electrodes including said flat compression plate, using a HF-generator that is connected to the one or more electrodes via one or more cables, while the vacuum environment is maintained within the airtight tank, applying a preservation liquid and/or dye around said wood, while the vacuum environment is maintained within the airtight tank, wherein said wood is completely immersed in said preservation liquid and/or dye, and then pressurizing said airtight tank to establish a pressure on the liquid and/or dye surrounding said wood using a compressor that is connected to the airtight tank through a compressor valve placed between the compressor and the airtight tank, wherein said heating is performed simultaneously to, subsequent to, or both, said applying a preservation liquid and/or dye around said wood and while said wood is immersed in said preservation liquid and/or dye.

11. The method according to claim 10, wherein said vacuum environment has a gas pressure in the range of approximately 0.04 bar to approximately 0.1 bar.

12. The method according to claim 10, wherein said wood comprises a plurality of layers, and an electrode of said one or more electrodes is placed between two neighbouring layers of said plurality of layers.

13. The method according to claim 10, wherein said wood comprises a plurality of layers, and an electrode of said one or more electrodes is placed between every two neighbouring layers of said plurality of layers.

14. The method according to claim 10, wherein said one or more electrodes constitute two groups of electrodes having opposite polarities.

15. The method according to claim 10, wherein two neighbouring electrodes of said one or more electrodes have opposite polarities.

16. The method according to claim 10, wherein said electromagnetic radiation has a frequency in the range of approximately 10 to approximately 30 MHz.

17. The method according to claim 10, wherein said electromagnetic radiation has a frequency of approximately 13.56 MHz or approximately 27.12 MHz.

18. The method according to claim 10, wherein said wood is arranged to define four flat sides at right angles, and said compression system comprises a plurality of flat compression plates for establishing said mechanical pressure through said four flat sides.

19. The method according to claim 10, wherein said compression system comprises a clamp for establishing a part of, or the whole of, said mechanical pressure.

20. The method according to claim 10, wherein said compression system comprises a hydraulic or pneumatic compressor for providing said mechanical pressure.

21. The method according to claim 10, wherein said vacuum environment defines a prior gas pressure prior to applying said preservation liquid and/or dye and a subsequent gas pressure simultaneous to and/or subsequent to applying said preservation liquid and/or dye, and wherein the ratio of said subsequent gas pressure over said prior gas pressure is in the range of approximately 1 to approximately 2.

22. The method according to claim 10, wherein said pressurized environment has a gas pressure in the range of approximately 1 bar to approximately 12 bar.

* * * * *